US007475436B2

(12) United States Patent
Heukamp

(10) Patent No.: US 7,475,436 B2
(45) Date of Patent: Jan. 13, 2009

(54) DISPENSER STICK

(75) Inventor: Wolfgang Heukamp, Swisttal (DE)

(73) Assignee: RPC Wiko GmbH, Pulheim (DE)

( * ) Notice: Subject to any disclaimer, the term of this patent is extended or adjusted under 35 U.S.C. 154(b) by 112 days.

(21) Appl. No.: 10/553,181

(22) PCT Filed: Aug. 23, 2004

(86) PCT No.: PCT/EP2004/009388

§ 371 (c)(1),
(2), (4) Date: Oct. 13, 2005

(87) PCT Pub. No.: WO2005/020745

PCT Pub. Date: Mar. 10, 2005

(65) Prior Publication Data

US 2006/0233589 A1 Oct. 19, 2006

(30) Foreign Application Priority Data

Aug. 25, 2003 (DE) ..... 203 13 223 U

(51) Int. Cl.
*B43K 21/00* (2006.01)

(52) U.S. Cl. ..... 4/84; 401/82

(58) Field of Classification Search ..... 401/59–61, 401/66, 80, 84, 98, 176–180
See application file for complete search history.

(56) References Cited

U.S. PATENT DOCUMENTS 978,189 A * 12/1910 Moss ..... 401/84
4,139,311 A * 2/1979 Lorscheidt ..... 401/55
4,781,483 A * 11/1988 Lorscheidt ..... 401/55
4,979,840 A * 12/1990 Madaus et al. ..... 401/202
5,445,465 A * 8/1995 Cardia ..... 401/175
5,984,554 A * 11/1999 Bouix ..... 401/98

FOREIGN PATENT DOCUMENTS

| | | |
|---|---|---|
| DE | 76 13 989 | 5/1976 |
| DE | 31 18 893 | 11/1982 |
| DE | 36 33 754 | 4/1988 |
| DE | 698 03 620 | 11/2002 |
| FR | 652 218 | 4/1928 |

* cited by examiner

*Primary Examiner*—Huyen Le
(74) *Attorney, Agent, or Firm*—Friedrich Kueffner

(57) ABSTRACT

The invention relates to a dispenser stick (1) for storing and applying a pasty gradually removable stick compound from a cosmetic or otherwise product, such as for example a deodorant stick or glue stick. Said dispenser stick is provided with a cylindrical housing (1') comprising an upper dispensing opening, a closure cap (2) that hermetically seals the dispensing opening via a sealing lip (5), and a feeding plunger (7) that can be axially displaced inside the housing (1'). The dispenser stick (1) is characterized in that the feeding plunger (9) can only be displaced towards the dispensing opening and is blocked in the opposite direction and in that the closure cap (2) is configured as a double-walled structure that has an interior cap (3) that can be axially displaced relative to the closure cap (2). Advantageously, the housing (1') is double-walled with an exterior housing (9) that can be closed together with the closure cap (2) and with an interior housing (6) accommodating the stick compound, which can be displaced axially in the exterior housing (9).

7 Claims, 7 Drawing Sheets

DISPENSER STICK

The invention concerns a dispenser stick for storing and applying a pasty dispensable stick compound that consists of a cosmetic product or some other type of product, for example, a deodorant stick or glue stick, which comprises a stick-shaped housing with an upper dispensing outlet, a closure cap that seals the dispensing outlet airtight by means of a sealing lip, and a feeding plunger that can be moved axially inside the housing.

Dispenser sticks for applying a pasty dispensable product, for example, deodorant sticks or glue sticks, are known in various designs. Dispenser sticks in which the stick compound is used by moving it upward out of the dispensing outlet by a supporting plunger by means of a rotating base with a spindle or by a pushing device are widely used. To use this type of dispenser stick, the closure cap must first be removed and then the plunger must be pushed up. Accordingly, two separate manual operations are necessary to place the dispenser stick in a position for applying it.

To create a dispenser stick that has a simpler design and is easier to use, German Utility Patent GM 76 13 989 proposes that the closure cap be sealed against the housing by means of a sealing lip in such a way that, when the closure cap is removed, the stick compound is pushed a certain distance out of the housing by the negative pressure produced by the removal of the cap. A rotating spindle or a pushing device is no longer necessary. The only function of the plunger as a feeding plunger is to provide an airtight seal of the stick compound towards the bottom.

A disadvantage of this previously known dispenser stick is that the stick compound is pushed back into the housing during its application. The only resistance to the stick compound being pushed back into the housing is the static friction of the feeding plunger and, depending on that, the static friction of the stick compound on the inside wall of the housing as well. This static friction may not be too great, either, because it must be possible, even if the stick compound that has been pushed out is not used, to screw the closure cap back onto the housing, at which time the protruding stick compound is pushed back into the housing. In this regard, when the stick compound is pushed back into the housing, it is unavoidable that the stick compound is forced out to the side at the upper edge of the housing.

Proceeding from this prior art, the objective of the invention is to design a dispenser stick of the specified type in such a way that, despite continued simple design and handling, the disadvantage of the stick compound being pushed back into the housing is eliminated.

This objective is achieved with the characterizing features of claim 1, according to which the feeding plunger can be moved only towards the dispensing outlet and is locked in the opposite direction, and the closure cap is designed with a double wall with an inner cap that can be axially displaced relative to the closure cap. Advantageous modifications of the invention are specified in the dependent claims.

The locking of the feeding plunger in the direction opposite the dispensing direction in accordance with the invention advantageously prevents the stick compound from being pushed back into the housing as the stick compound is being applied, during which axial pressure on the stick compound is unavoidable. This locking of the feeding plunger is accomplished, for example, by mounting a retaining spring below the feeding plunger. The retaining spring catches on the inside wall of the housing and is designed in such a way that axial displacement in the dispensing direction remains possible.

Alternatively, in accordance with an advantageous modification of the invention, the inside wall of the housing can be provided with fine serration or with fine locking grooves, in which the correspondingly designed feeding plunger catches to lock it in the direction opposite the dispensing direction.

Since the stick compound that has been pushed out of the housing for application can no longer be pushed back into the housing, but it must be possible to close the dispenser stick even with unused stick compound that has been pushed out, in accordance with the invention, the closure cap is designed with a double wall and an inner cap. As the closure cap is being screwed onto the housing, the inner cap sets down on the protruding stick compound and is then pushed axially into the closure cap as the screwing operation continues. The inner cap is connected with the closure cap by a spring element in such a way that it is supported, so that when the cap is unscrewed again, initially only the closure cap and then the inner cap are axially displaced due to the spring tension that was previously produced.

In an advantageous modification of the invention, both the closure cap and the housing have a double-walled construction. An axially displaceable inner housing, which extends from the top of the outer housing and serves to hold the stick compound, is mounted inside the outer housing, which can be closed with the closure cap. The length of the part of the inner housing that extends from the outer housing corresponds to the length of the inner cap, so that when the closure cap is screwed on, the upper base of the inner cap rests on the upper edge of the inner housing, and the lower edge of the inner cap rests on the upper edge of the outer housing.

A crucial advantage of this double-walled design of the housing is seen during the filling of the inner housing with the stick compound, which is usually still liquid at this point. The inner housing, which is pushed only partially into the outer housing during the filling operation, is pushed completely into the outer housing after the filling operation has been completed and the stick compound has hardened, and the stick compound and the feeding plunger, which rests on a central projection of the base of the housing, remain unchanged in their position. This causes the stick compound to be pushed within the inner housing towards the dispensing outlet, so that the stick compound becomes detached from the inner wall of the inner housing. The usual adhesion of the stick compound to the inner wall of the housing that occurs during the filling operation in previously known dispenser sticks is thus successfully prevented before the first use despite the conventional filling operation, and the stick compound can then be easily advanced even during its first use.

The advancing of the stick compound in the dispenser stick of the invention to allow it to be applied occurs indirectly by the production of a negative pressure between the inner cap and the inner housing when the closure cap is screwed on. For this purpose, the upper projecting region of the inner housing is provided with an outwardly projecting annular sealing lip, which, when the closure cap has been screwed on, rests against the inner wall of the inner cap and produces a seal. In this regard, a cavity formed between the inner housing and the inner cap is sealed towards the bottom by the sealing lip. When the closure cap is unscrewed and the inner cap is moved axially upward in the dispensing direction, this cavity becomes larger, and the resulting negative pressure "pulls" the column of stick compound a small distance upward out of the dispensing outlet. The possible amount of this axial displacement of the stick compound is adjusted in advance by suitable shaping of the annular cavity between the inner cap and the inner housing.

In accordance with the invention, the sealing lip is mounted at a downward angle on the inner housing in such a way that it acts as a check valve, and when the outer housing is closed by the closure cap, the resulting positive air pressure inside the diminishing annular cavity is relieved to the outside by venting via the sealing lip.

Further advantages, features, and properties of the invention, especially the manner of operation of the dispenser stick of the invention, are explained in greater detail below with reference to the specific embodiments illustrated in the drawings.

FIG. 1 shows a dispenser stick in an exploded view.

FIG. 1*a* shows details of FIG. 1.

FIG. 2 shows the dispenser stick of FIG. 1 in its assembled, open state.

FIGS. 3*a* to 3*c* show vertical sections of the dispenser stick of FIG. 1 in different positions of use.

FIG. 4 shows a vertical section of the dispenser stick of FIG. 1, filled in the initial position.

FIGS. 4*a* and 4*b* show two different enlarged partial sections of FIG. 4.

Figure 1:
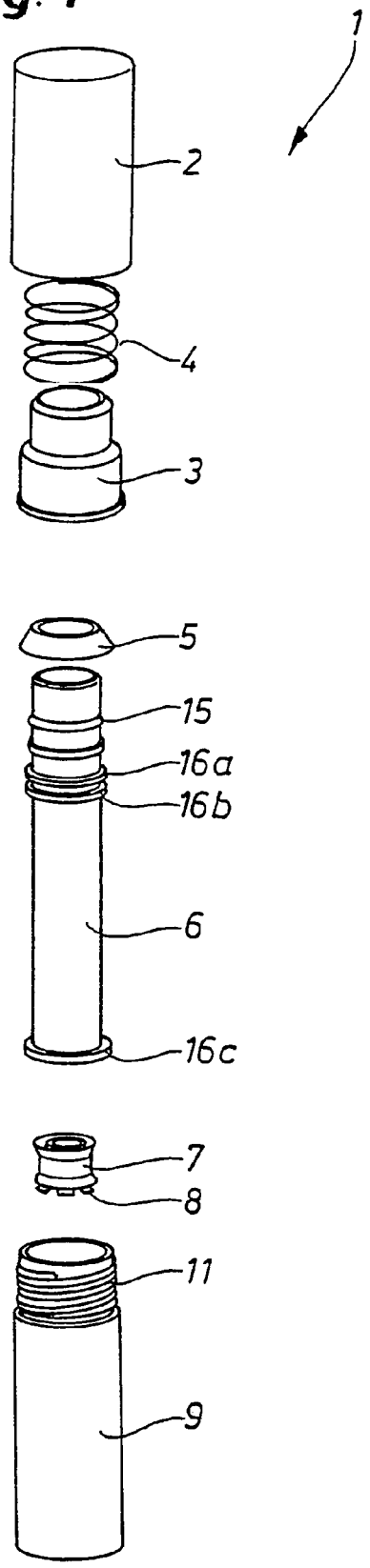
Figure 2:
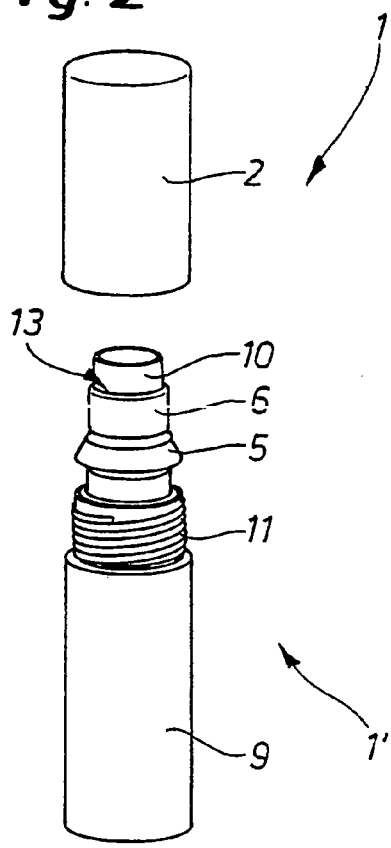
Figure 1A:
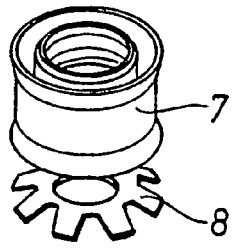

The exploded view in FIG. 1 shows the individual parts of a dispenser stick 1 of the invention in their order of assembly. The enlarged view in FIG. 1*a* shows details of the feeding plunger 7 and the retaining spring 8. FIG. 2 shows the assembled housing 1', from which the stick compound 10 has emerged. The closure cap 2 can be screwed onto the housing 1'.

The housing 1' of the dispenser stick consists of an outer housing 9, which is closed at the bottom and into which the longer inner housing 6 can be inserted from above. The inner housing 6 has a tubular construction, so that the feeding plunger 7 with the retaining spring mounted below it can be inserted through the open lower end. The upper region of the inner housing 6 that projects above the outer housing 9 is formed with two annular webs 15, between which the downwardly angled sealing lip 5 is mounted. Below the annular webs 15, the lower end of the inner housing 6 is provided with additional annular webs 16*a*, 16*b*, 16*c*, which support the inserted inner housing 6 against the outer housing 9. The upper part of the outer housing 9 is provided with an external thread 11, onto which the closure cap 2 with the inserted helical spring 4 and inner cap 3 is screwed to close the dispenser stick 1.

Figure 3C:
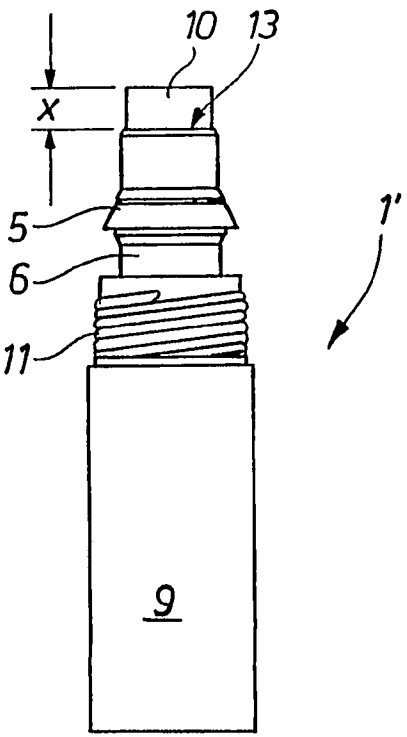
Figure 3B:
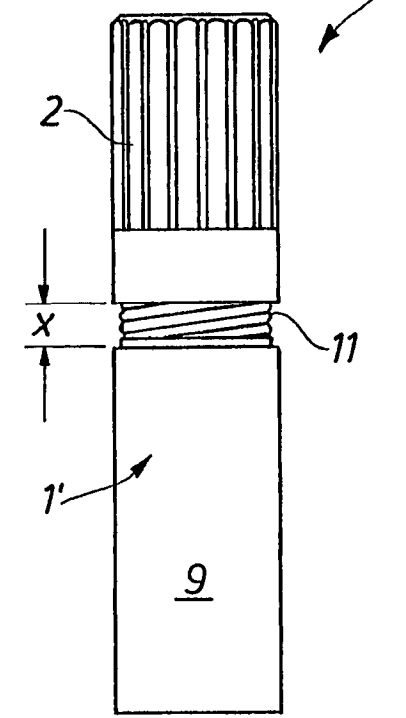
Figure 3A:
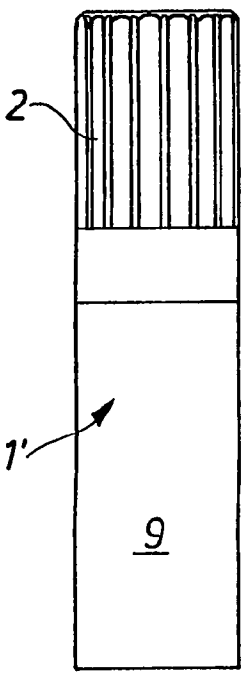

FIGS. 3*a* to 3*c* each show front elevations of the dispenser stick 1 and the housing 1' in different positions of use. FIG. 3*a* shows the dispenser stick 1 with the closure cap 2 screwed on in its initial position before use. In FIG. 3*b*, the closure cap 2 has been unscrewed by the distance x, which, as shown in FIG. 3*c*, has caused the stick compound 10 to be brought out of the housing 1' and the inner housing 6 by about the same distance x. The closure cap 2 is completely removed from the outer housing 9, and the stick compound 10, which has been displaced towards the outside with the aid of the sealing lip 5, can be dispensed and applied.

Figure 4:
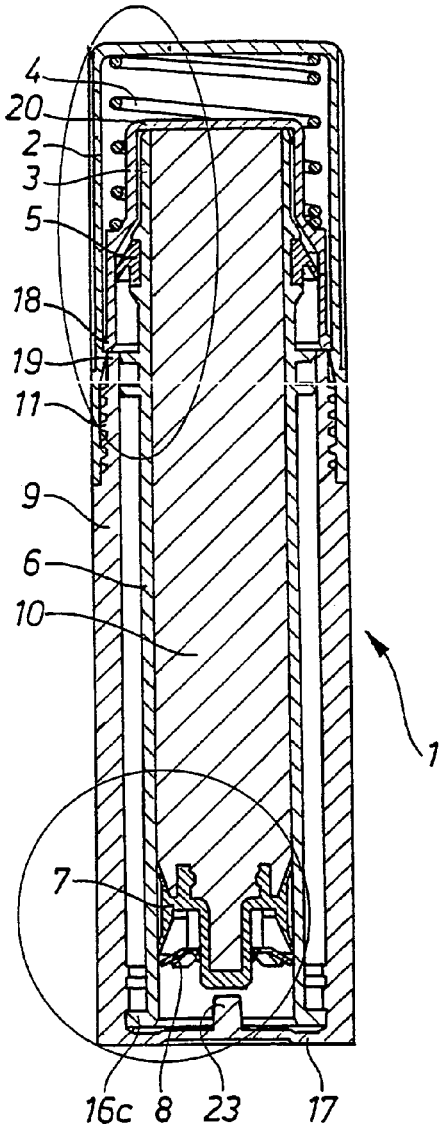
Figure 4A:
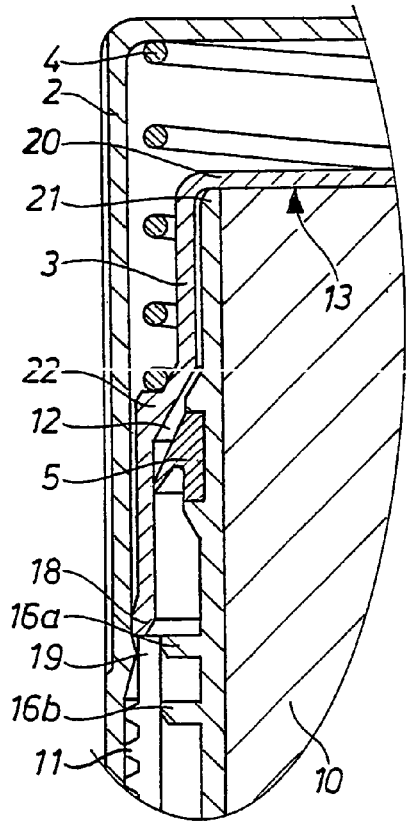
Figure 4B:
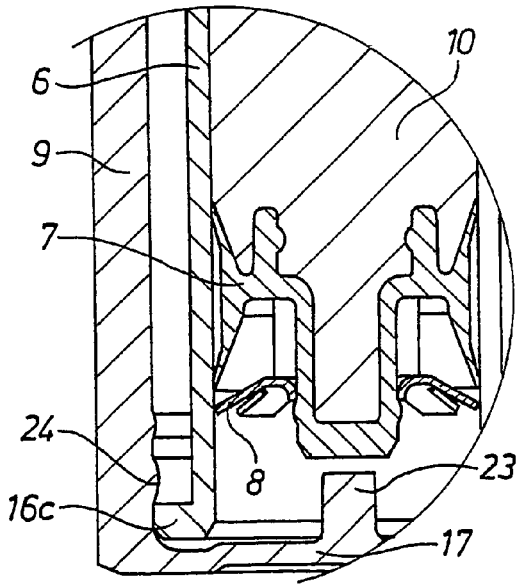
Figure 7:
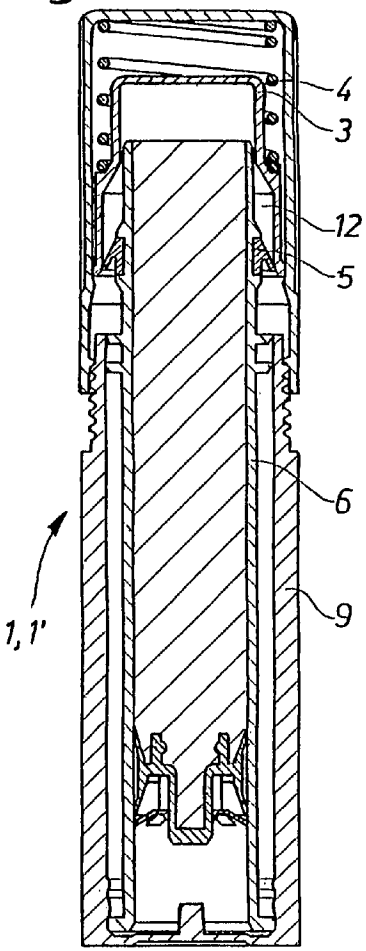
FIGS. 5 to 9 show vertical sections of the dispenser stick of FIG. 1 in different positions of use.
Figure 6:
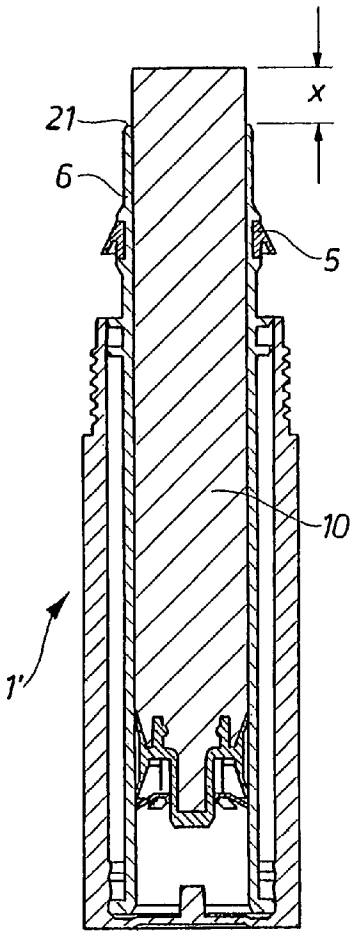
Figure 5:
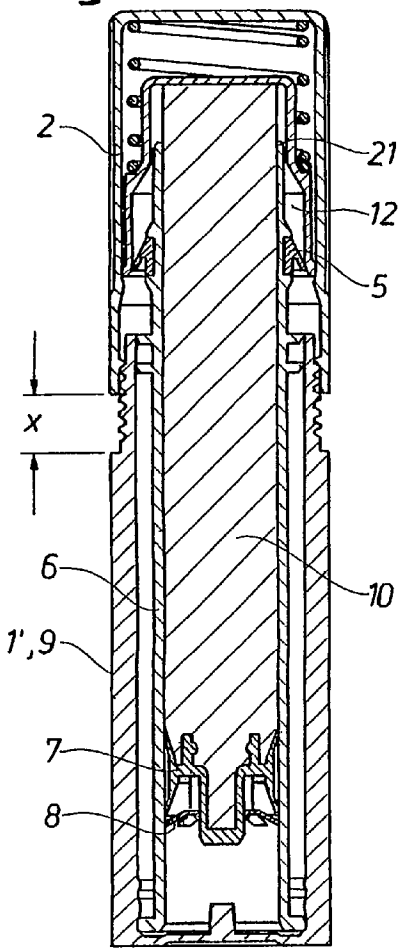

FIG. 4 shows the dispenser stick 1 with the closure cap 2 screwed on in a vertical section that corresponds to FIG. 3*a*. To provide a better view, the important upper and lower regions of FIG. 4 are shown in enlarged partial sections in FIGS. 4*a* and 4*b*, respectively. In FIGS. 4, 4*a*, and 4*b*, the individual parts that constitute the dispenser stick 1 (see also FIGS. 1 and 2 in this regard) are assembled and ready to use. In the illustrated initial position, the feeding plunger 7 with the retaining spring 8 mounted below it is located directly above a central projection 23 of the base 17 of the outer housing 9 with the stick compound 10 filling the space above it. The lower annular web 16*c* of the inner housing 6 rests on the base 17 of the outer housing 9, and the inner housing 6 is connected with the outer housing 9 in a snap connection by means of the web 16*c* and an annular bead 24 of the outer housing 9. The inner housing 6 is supported against the outer housing 9 by this web 16*c* and by the two upper annular webs 16*a* and 16*b*. The closure cap 2 is completely screwed on, and the inner cap 3, supported by the helical spring 4, rests with its lower edge 18 on the upper edge 19 of the outer housing 9 and with its upper base 20 on the upper edge 21 of the inner housing 6. The dispensing outlet 13 (cf. also FIG. 2) formed by the upper edge 21 is thus sealed airtight by the inner cap 3. The inside diameter of the upper projecting part of the inner cap 3 is approximately the same as the outside diameter of the inner housing 6, and the inner cap 3 expands in a step, so that the outside diameter of its lower part approximately matches the inside diameter of the closure cap 2. The step 22 formed by this expansion serves as a seat for the helical spring 4 inserted in the closure cap. At the same time, the step 22, together with the sealing lip 5, forms a cavity 12 that is sealed towards the bottom, enlarges when the closure cap 2 is screwed on, and produces the negative pressure necessary for "pulling" the stick compound up by suction. In FIGS. 5, 6, and 7, this process of "pulling" the stick compound up by suction is illustrated separately in vertical sections.

In FIG. 5, the closure cap 2 of the dispenser stick 1 has been unscrewed by the distance x relative to the initial position shown in FIG. 4. This enlarges the cavity 12, as shown, and the resulting negative pressure causes the stick compound 10 to be pulled out of the inner housing 6 by the amount x. In the illustrated position, the sealing lip 5 has reached the lower end of the inner cap 3, so that when the closure cap 2 is further unscrewed, the cavity 12 is vented, and the stick compound 10 remains in the position that it has reached.

In FIG. 6 (corresponding to FIG. 3*c*), the closure cap 2 is completely removed from the inner housing 6, and the stick compound 10, which extends above the upper edge 21 of the inner housing 6 by a distance x, can be dispensed.

As FIG. 7 shows, after the stick compound 10 has been dispensed, the closure cap 2 is screwed partially back onto the outer housing 9, and the sealing lip 5 makes sealing contact with the inner housing 6. As the closure cap 2 is screwed on further, and the cavity 12 becomes smaller, the positive pressure that develops in the cavity 12 is relieved to the outside by the sealing lip 5, which is mounted at a downward angle.

Figure 8:
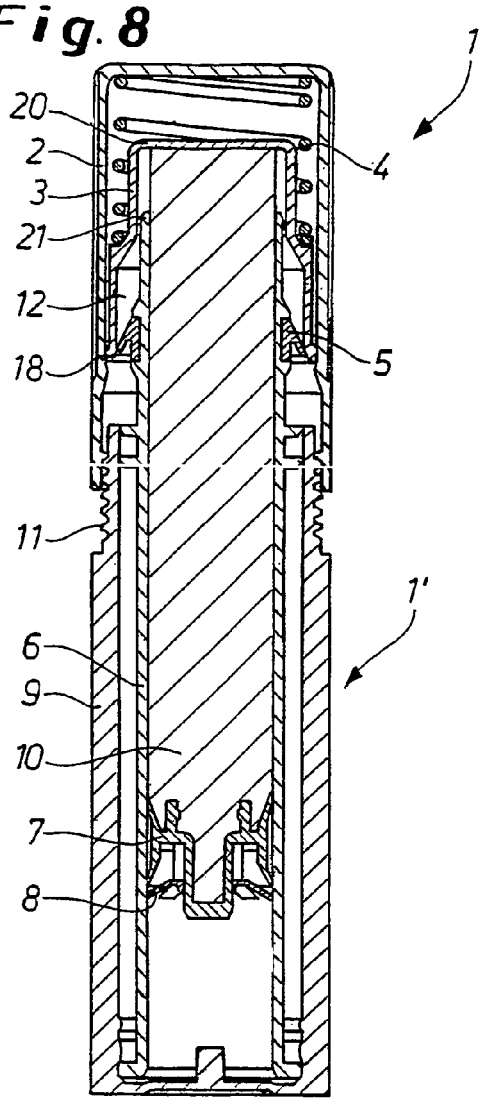
Figure 9:
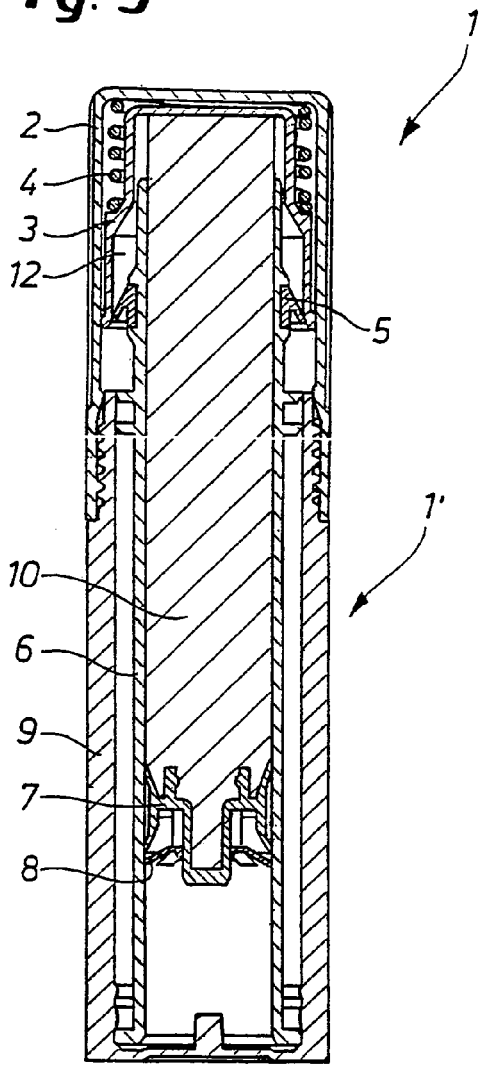

FIGS. 8 and 9 serve to illustrate the function of the double-walled closure cap 2. In the case illustrated here, the stick compound protruding from the inner housing 6 has not been completely dispensed or used. As the closure cap 2 is screwed on, the inner cap 3 is first moved down until its upper base 20 rests on the stick compound 10. This position is shown in FIG. 8. As the closure cap 2 is further screwed on, the inner cap 3 can no longer follow its downward path, because the retaining spring 8 arrests the feeding plunger 7, so that the stick compound 10 cannot be pushed down. The inner cap 3 remains in its position and is axially displaced within the closure cap 2 against the spring tension of the helical spring 4, as is shown in FIG. 9. The annular cavity 12 remains unchanged during this operation, and the sealing lip 5 remains at the lower edge 18 of the inner cap 3. When the closure cap 2 is unscrewed again, the helical spring 4 causes the inner cap 3 to remain in its position at first. Due to the illustrated position of the sealing lip 5, negative pressure is no longer produced during the subsequent displacement of the inner cap 3, and further upward movement of the stick compound 10 is prevented.

Figure 10:
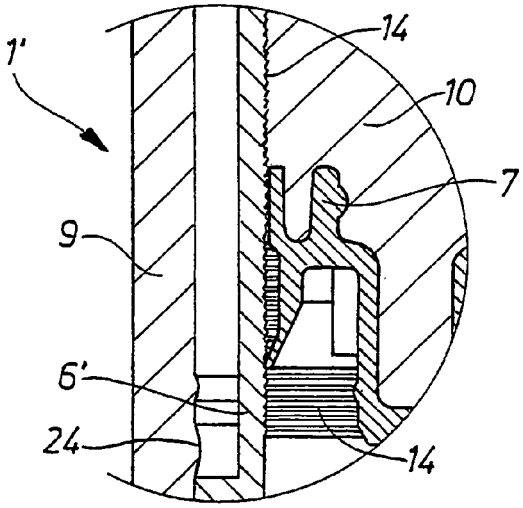
FIG. 10 shows a vertical partial section of a dispenser stick with serration for locking the plunger.

In the dispenser stick 1 of FIGS. 1 to 9, the locking effect on the feeding plunger 7 was produced by a retaining spring 8 mounted below the feeding plunger 7. In accordance with the invention, however, this locking effect can also be produced solely by a feeding plunger 7 with an inner housing suitably adapted to achieve this effect. In FIG. 10, which shows the lower part of the housing 1' of a dispenser stick 1 with outer housing 9 and stick compound 10 in an enlarged vertical partial section, the inner wall of the inner housing 6' is designed with annular fine serration 14. The lateral edges of the feeding plunger 7 catch in this serration in such a way that axial displacement of the feeding plunger 7 is possible in the dispensing direction but not in the opposite direction.

Figure 13:
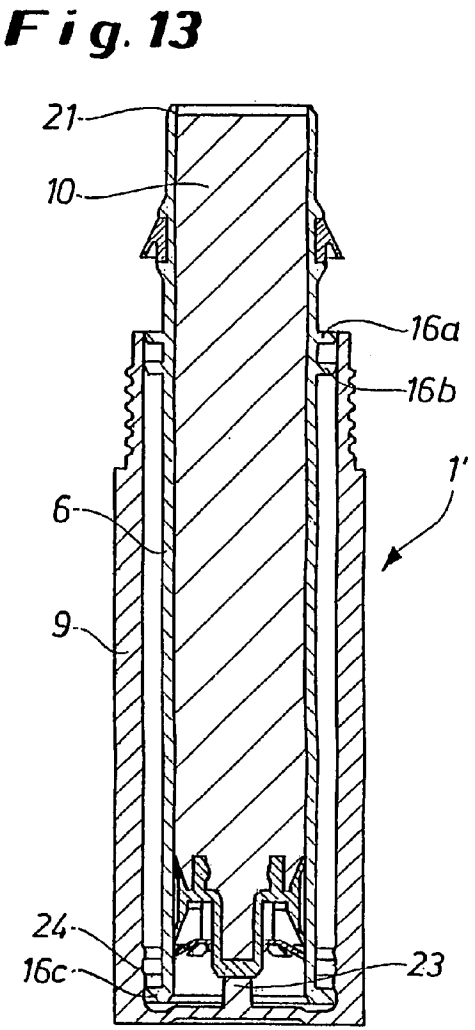
FIGS. 11 to 13 show the housing of the dispenser stick of FIG. 1 in different filling positions.
Figure 12:
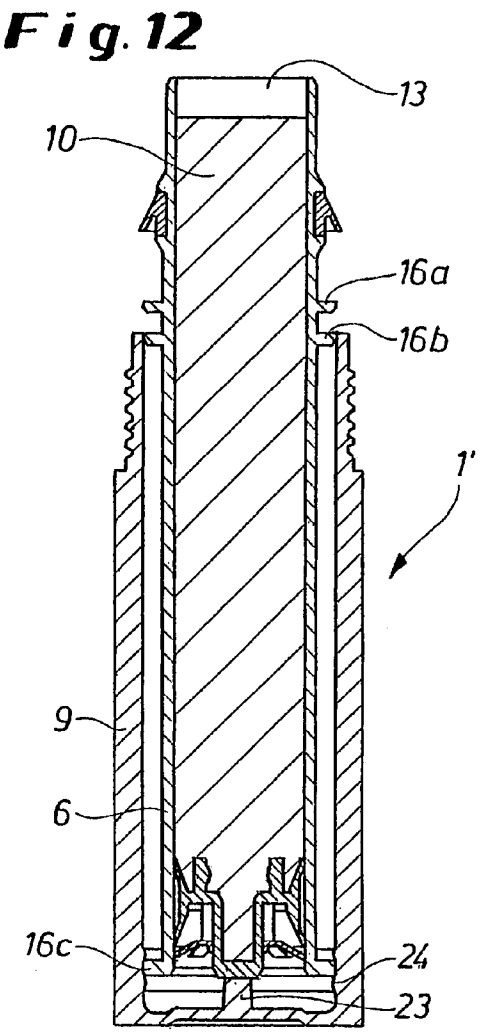
Figure 11:
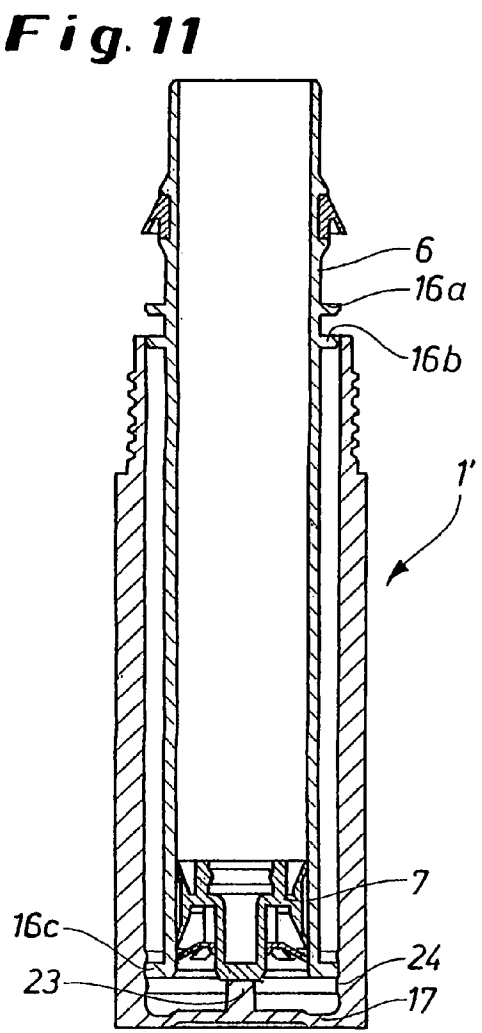

In accordance with the invention, the housing 1' of the dispenser stick 1 can have a double-walled design. The principle on which this housing design is based for simple filling with stick compound 10 will now be explained in greater detail with reference to FIGS. 11 to 13. FIG. 11 shows a vertical section of the dispenser stick 1 without its closure cap 2 before it has been filled with the stick compound. The inner housing 6 has been inserted in the outer housing 9 as far as the annular web 16*b*, so that the lower web 16*c* is located some distance above the base 17 of the outer housing 9 on an annular bead 24 of the outer housing 9, and the feeding plunger 7 rests on the central projection 23 of the housing base 17. In this position, the stick compound 10 is poured in from above, and the filling ends a certain distance below the upper edge 21 of the inner housing 6, as shown in FIG. 12. Then, as shown in FIG. 13, after the stick compound 10 has hardened, the inner housing 6 is pushed farther into the outer housing 9, so that the upper annular web 16*a* is also pushed into the outer housing 9, and now the lower annular web 16*c* rests on the housing base 17 below the annular bead 24. This causes the inner housing 6 to lock with the outer housing 9 in a snap connection prevents undesired upward movement of the inner housing 6 when negative pressure is present in the cavity 12. Since the stick compound 10 cannot follow this movement due to the blocking of the feeding plunger 7, which rests on the central projection 23 of the housing base 17, the stick compound 10 is displaced inside the inner housing 6 as far as the upper edge 21. The stick compound 10, which possibly sticks to the inner wall of the inner housing 6 as a result of the filling operation, is thus detached from the inner wall and can then be easily moved even during its first use.

Figure 14:
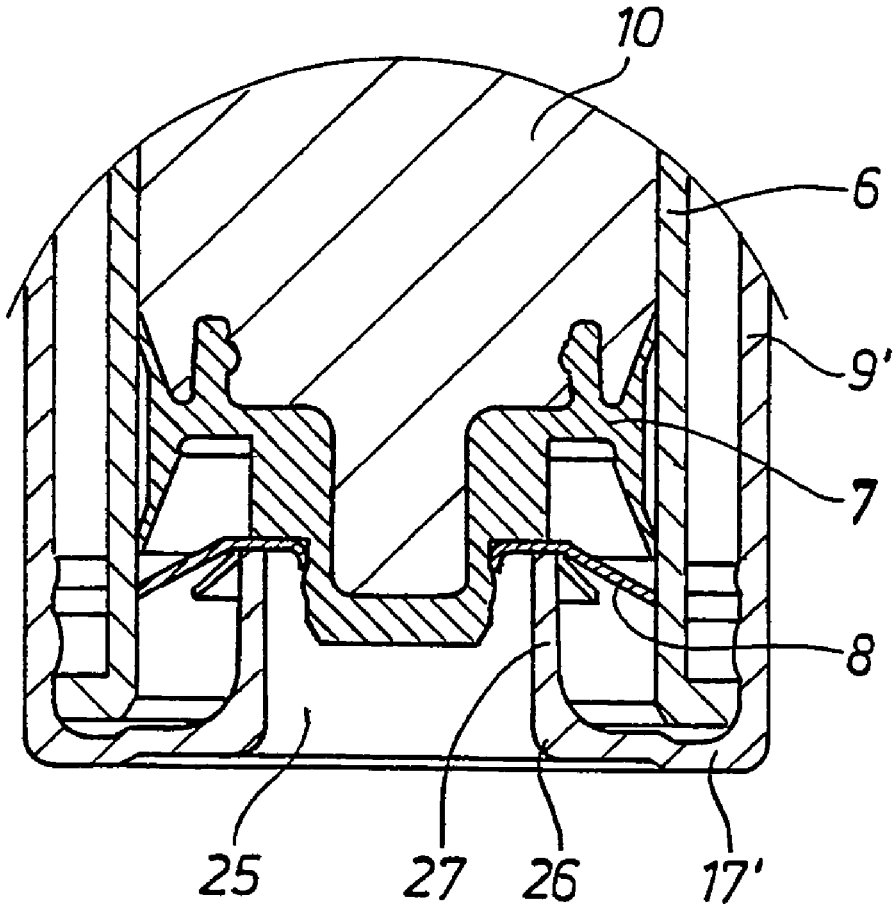
FIG. 14 shows a vertical partial section of a dispenser stick with the housing base opened.

To ensure that the inner housing 6 can be inserted into the outer housing 9 as far as the housing base 17 after the filling operation has been completed, while the position of the feeding plunger 7 remains unchanged, in the embodiment shown in Figures 11 to 13, the feeding plunger 7 rests in the filled position on a central projection 23 of the housing base 17 some distance above the housing base 17. Alternatively, however, it is also possible, in accordance with the invention, as is shown in the vertical partial section of FIG. 14, to provide an annular housing base 17' of the outer housing 9' with a central opening 25 and elimination of the central projection 23. In this case, the separation of the feeding plunger 7 from the housing base 17' that is required for the filling operation is provided by an annular web 27, which turns up at the lower edge 26 of the central opening 25 and serves as a support for the feeding plunger 7. The advantage of this alternative design of the outer housing 9' with a housing base 17' that is open at the bottom is that the feeding plunger 7 is accessible from the outside through the central opening 25. If, for example, the sealing lip 5 is damaged by improper use, so that negative pressure for dispensing the stick compound 10 can no longer be produced, a long object can be inserted through the open base of the outer housing 9' to push up the feeding plunger 7 and thus the stick compound 10.

The invention is not limited to the illustrated embodiments but rather can be constructed in a variety of ways with respect to the design and the individual required components of the dispenser stick as long as the features of the invention of a double-walled design of the closure cap and a design of the feeding plunger with a reverse movement arresting mechanism are retained.

LIST OF REFERENCE NUMBERS

1 dispenser stick
1' housing of 1
2 closure cap of 1
3 inner cap
4 helical spring
5 sealing lip
6, 6' inner housing
7 feeding plunger
8 retaining spring
9, 9' outer housing
10 stick compound
11 external thread
12 cavity
13 dispensing outlet
14 annular serration
15 annular webs
16*a*-16*c* annular webs
17, 17' housing base
18 lower edge of the inner cap 3
19 upper edge of the outer housing 9
20 upper base of the inner cap 3
21 upper edge of the inner housing 6
22 step
23 central projection
24 annular bead
25 central opening
26 inner edge of the central opening 25
27 annular web
x displacement distance (stick compound, inner cap)

The invention claimed is:

1. Dispenser stick (1) for storing and applying a pasty dispensable stick compound (10) that consists of a cosmetic product or other type of product, which comprises a stick-shaped housing (1') with an upper dispensing outlet (13), a closure cap (2) that seals the dispensing outlet (13) airtight by means of a sealing lip (5), and a feeding plunger (7) that can be moved axially inside the housing (1'), wherein the feeding plunger (7) can be moved only towards the dispensing outlet (13) and is locked in the opposite direction, and the closure cap (2) is comprised of a double wall with an inner cap (3) that can be axially displaced relative to the closure cap (2) , wherein the housing (1') is double-walled with an outer housing (9) that can be closed with the closure cap (2) and with an inner housing (6) that can be axially displaced in the outer housing (9) and serves to hold the stick compound (10), wherein to fill the dispenser stick with the stick compound (10) in the filling position of the housing (1'), the feeding plunger (7) and the inner housing (6) are located some distance above the housing base (17), such that, after the filling of the housing (1') with the stick compound (10) has been completed, the inner housing (6) is pushed completely into the outer housing (9) until it reaches the housing base (17), while the position of the feeding plunger (7) remains unchanged, and that during this operation, the stick compound (10) becomes detached from the inner wall of the inner housing (6).

2. Dispenser stick (1) in accordance with claim 1, wherein the upper region of the inner housing (6) is provided with an outwardly projecting annular sealing lip (5), which, when the closure cap (2) has been slipped onto or screwed onto the outer housing (9), presses against the inner wall of the inner cap (3) to produce a seal.

3. Dispenser stick (1) in accordance with claim 1, wherein a lower web (l6*c*) of the inner housing (6) rests on an annular bead (24) of the outer housing (9), and the inner housing (6) is supported against the outer housing (9) by means of the web (l6*c*) and an upper annular web (16*b*).

4. Dispenser stick (1) in accordance with claim 3, wherein in the filling position of the housing (1'), the feeding plunger (7) rests on a central projection (23) of the housing base (17).

5. Dispenser stick (1) in accordance with claim 3, wherein the housing base (17') has an annular design with a central opening (25), whose inner edge (26) is turned up with an annular web (27), on which the feeding plunger (7) is supported in the filling position.

6. Dispenser stick (1) in accordance with claim 1, wherein the web (l6*c*) of the inner housing (6) is moved over the bead (24) of the outer housing (9), thereby causing the inner housing (6) to lock with the outer housing (9) in a snap connection, which prevents subsequent upward movement of the inner housing (6) when negative pressure is present in the cavity (12).

7. The dispenser stick (1) in accordance with claim 1, wherein in an upper region protruding from the outer housing (9), the inner housing (6) comprises two annular webs (15), wherein the sealing lip (5) is inserted between the webs (15) so as to protrude downwardly at an angle, such that, when the closure cap (2) is slipped onto or screwed onto the outer housing (9), the sealing lip (5) is pressed against an inner wall of the inner cap (3) and seals an annular cavity (12) between the inner cap (3) and the inner housing (6).

* * * * *